United States Patent [19]

Hansen

[11] Patent Number: 4,703,682

[45] Date of Patent: Nov. 3, 1987

[54] VARIBLE DISPLACEMENT PISTON PUMP OR MOTOR

[75] Inventor: Gunnar L. Hansen, Nordborg, Denmark

[73] Assignee: Danfoss A/S, Nordborg, Denmark

[21] Appl. No.: 873,550

[22] Filed: May 21, 1986

[30] Foreign Application Priority Data

Jun. 3, 1985 [DE] Fed. Rep. of Germany ..... 3519822

[51] Int. Cl.[4] ..... F01B 13/04

[52] U.S. Cl. ..... 92/12.2; 91/506; 91/486

[58] Field of Search ..... 91/505, 506, 486; 92/12.2; 417/222

[56] References Cited

U.S. PATENT DOCUMENTS

| | | | |
|---|---|---|---|
| 3,070,031 | 12/1962 | Puryear | 417/222 |
| 3,188,971 | 6/1965 | Puryear | 417/222 |
| 3,252,419 | 5/1966 | Tyler | 417/222 X |
| 3,648,567 | 3/1972 | Clark | 91/505 |
| 3,747,476 | 7/1973 | Ankeny et al. | 91/506 X |
| 3,873,240 | 3/1975 | Leduc et al. | 417/222 |
| 4,142,452 | 3/1979 | Forster et al. | 91/506 |
| 4,149,830 | 4/1979 | Woodruff | 417/222 |
| 4,174,191 | 11/1979 | Roberts | 417/222 |
| 4,581,980 | 4/1986 | Berthold | 92/12.2 |

FOREIGN PATENT DOCUMENTS

| | | | |
|---|---|---|---|
| 1055959 | 4/1959 | Fed. Rep. of Germany | 92/12.2 |
| 113274 | 6/1984 | Japan | 92/12.2 |

*Primary Examiner*—Carlton R. Croyle
*Assistant Examiner*—Paul F. Neils
*Attorney, Agent, or Firm*—Wayne B. Easton; Clayton R. Johnson

[57] ABSTRACT

The invention relates to an adjustable axial piston engine having spaced apart end walls with a shaft extending between the end walls. A rotary carrier is attached to the shaft adjacent one of the end walls and an oblique adjusting plate is mounted adjacent the other end wall. A piston-cylinder unit extends between the carrier and the oblique plate. A pivot axis for the oblique plate includes a bearing arrangement between the plate and the adjacent end wall. A servo unit for adjustably rotating the plate about the pivot axis is provided between the plate and the adjacent end wall.

1 Claim, 5 Drawing Figures

VARIBLE DISPLACEMENT PISTON PUMP OR MOTOR

The invention relates to an adjustable axial piston engine comprising at least one piston-cylinder unit of the two working elements of which one is connected to a rotary carrier and the other is supported with the aid of an oblique plate which, by guiding a bearing element of a slide bearing applied to the plate in a bearing surface on a transverse wall of the housing, is adjustable about a pivot axis perpendicular to the tube axis, and comprising at least one servo-device for adjusting the oblique plate and having at least one servo-piston and servo-cylinder.

In a known axial piston engine of this kind (DE-OS 31 35 605), the bearing element consists of a cradle member having a width larger than the diameter of the slide track. This cradle member is disposed in a suitably large part-cylindrical bearing surface of the transverse wall of the housing. Two servo-devices are arranged substantially parallel to the piston-cylinder units and engage the oblique plate on the same side as the units. The cross-section of the axial engine is correspondingly large.

The invention is based on the problem of providing an axial piston engine of the aforementioned kind that can be given smaller structural dimensions, particularly a smaller cross-section.

This problem is solved according to the invention in that the slide bearing takes up only part of the surface of the oblique plate and the transverse wall and that the servo-device is disposed adjacent to the slide bearing on the same side of the oblique plate at a spacing from the pivot axis.

In this construction, the cross-section of the engine is governed substantially by the dimensions of the rotating carrier with the piston-cylinder unit. The at least one servo-device is accommodated within this cross-section because it is no longer disposed adjacent to these units but rather on the opposite side of the oblique side. By reducing the slide bearing, one not only creates the space for the servo-device but one obtains between the slide bearing and the servo-device a lever arm that can be utilised for pivoting the oblique plate. This lever arm is freely selectable within wide limits because the position of the servo-device is not impeded by the piston-cylinder units. Since smaller reciprocating strokes will suffice for shorter lever arms, one can also achieve shortening of the axial constructional length of the engine.

It is favorable if the bearing element consists of two partial ball members which are mutually offset in the direction of the pivot axis and if the bearing surface comprises two complementary bearing cups. The partial ball members as well as the bearing cups can be very readily produced so that an adequate bearing surface is produced at little expense.

At least that bearing cup which is disposed opposite to the piston-cylinder units that are under pressure should comprise a chamber within an annular supporting surface, it being possible to supply pressure fluid to this chamber. In this way one obtains pressure relief.

Desirably, the two bearing cups are disposed near the diametral line of the transverse wall to both sides of the shaft bearing. The subdivision into two bearing cups permits an adequate support to be achieved despite the presence of a shaft bearing. This leads to shorter lever arms and correspondingly short axial structural lengths for the servo-device.

Desirably, the servo-cylinders are in the form of bores in the transverse wall, and this results in a particularly simple construction.

At its outer end, the servo-piston preferably has a spherical depression in which a partial ball member lying against the oblique plate engages. This provides a ball joint so that the inclination of the oblique plate can be set without difficulty. With advantage, the partial ball member is not fixed to the oblique side so that it can execute a radial compensating movement when the oblique plate is tilted.

Preferably, the partial ball member is larger than a hemisphere and its diameter corresponds to that of the servo-cylinder bore. In this way, the partial ball member serves to guide the oblique plate so that transverse forces can be readily taken up.

Alternatively, the servo-piston may be applied to the oblique plate and have a spherical circumferential surface.

Desirably, there are two servo-devices mutually offset in the direction of the pivot axis. This gives a particularly reliable arrangement.

Further, there may be passages in the transverse wall that connect the chamber of at least one bearing cup to the cylinder for the at least one servo-device. Since the servo-device is supplied with a regulating pressure, this regulating pressure will also be available in the chamber to bring about pressure relief in the slide bearing.

Preferred examples of the invention will now be described in more detail with reference to the drawing, wherein.

Figure 1:
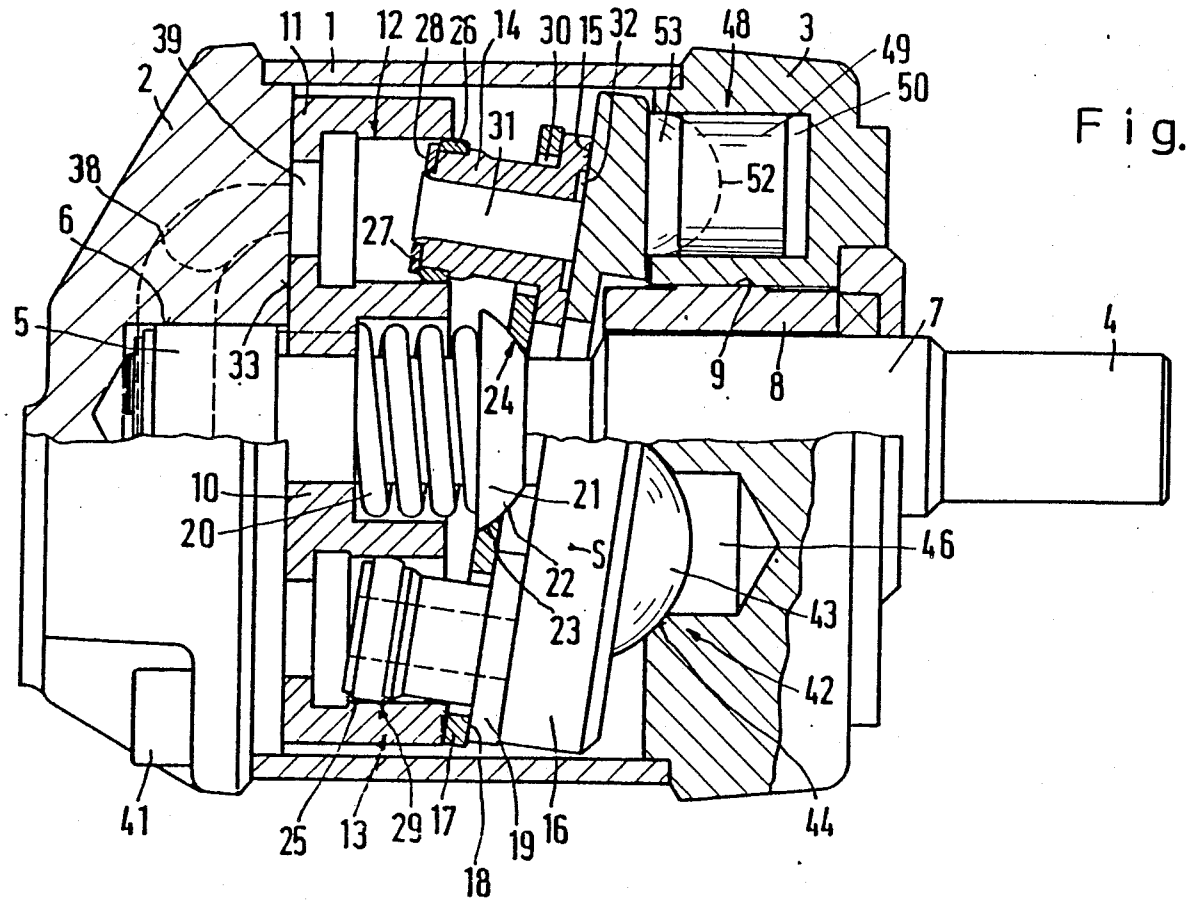
FIG. 1 is a longitudinal section through a first embodiment of an adjustable axial piston engine.

The axial piston engine illustrated in FIG. 1 can be operated as a motor or a pump. Its housing comprises two end or transverse walls 2 and 3 interconnected by a circumferential wall 1. A shaft 4 has its end 5 held in a bearing hole 6 of the transverse wall 2 and its section 7 held in a bearing bush 8 in the transverse wall 3. This bearing bush 8 is fixed with respect to the housing only over a part 9 of its circumference so that the shaft 4 has a certain amount of mobility.

The shaft 4 is connected by way of a gear coupling 10 to rotate with a carrier 11 but is axially displaceable. The carrier comprises a plurality of bores serving as cylinders 12 of piston-cylinder units 13. A piston 14 engaged in each of these cylinder bores carries at its end a slide surface 15 by which it is supported on an oblique plate 16. A planar pressure plate 17 lies on planar faces 18 of collars 19 applied to the piston 14 and is loaded by a central spring 20 which is supported by the carrier 11 on one side and by a collar 21 of shaft 4 on the other side. This collar has a spherical annular surface 22 which, with a complementary bearing surface 23 at the rim of a central aperture of pressure plate 17 through which the shaft 4 passes, forms a ball joint 24.

At its end remote from the oblique plate, the piston 14 comprises an annular sealing surface 25 which corresponds to the equatorial zone of a bearing surface having the diameter of the bore of the cylinder 12. It is located at the top surface of the band 26 which is held against a step 28 of the piston by means of a ring 27 that is crimped into position. In conjunction with the bore of the cylinder 12, this sealing surface forms a displaceable pivot joint. The pressure plate 17 has cut-outs 30 in the form of a radial elongate hole and therefore forming a radial guide for the piston 14. In this way, the slide face 15 can be fully applied to the oblique plate 16 in every rotary angular position of the carrier 11 despite the axial shortness of the piston-cylinder unit 13.

Each piston 14 comprises a throughpassage 31 in the form of a bore. In addition, the end is provided with an annular depression 32 having an external diameter approximately corresponding to the piston diameter in the cylinder 12. This results in substantial pressure relief so that the piston is pressed against the oblique plate 16 substantially only under the force of the central spring 20. At the same time, there is hydrostatic lubrication of the slide face so that the frictional losses are low.

The end face 33 of transverse wall 2 has two part-annular grooves, namely a vacuum groove 34 and a pressure groove 35. By way of passages indicated at 38, these are respectively connected to a vacuum connector 36 and a pressure connector 37 at the outer end of the transverse wall 2. The ends of the cylinders 12 have control orifices 39 with which they are alternately moved along the vacuum groove 34 and pressure groove 35. In this way, the piston chambers of the piston-cylinder units 13 can be charged and discharged. The preferred direction of rotation is given by an arrow 60. Clamping screws 41 for holding the housing parts 1 to 3 together are passed through holes 40.

Figure 3:
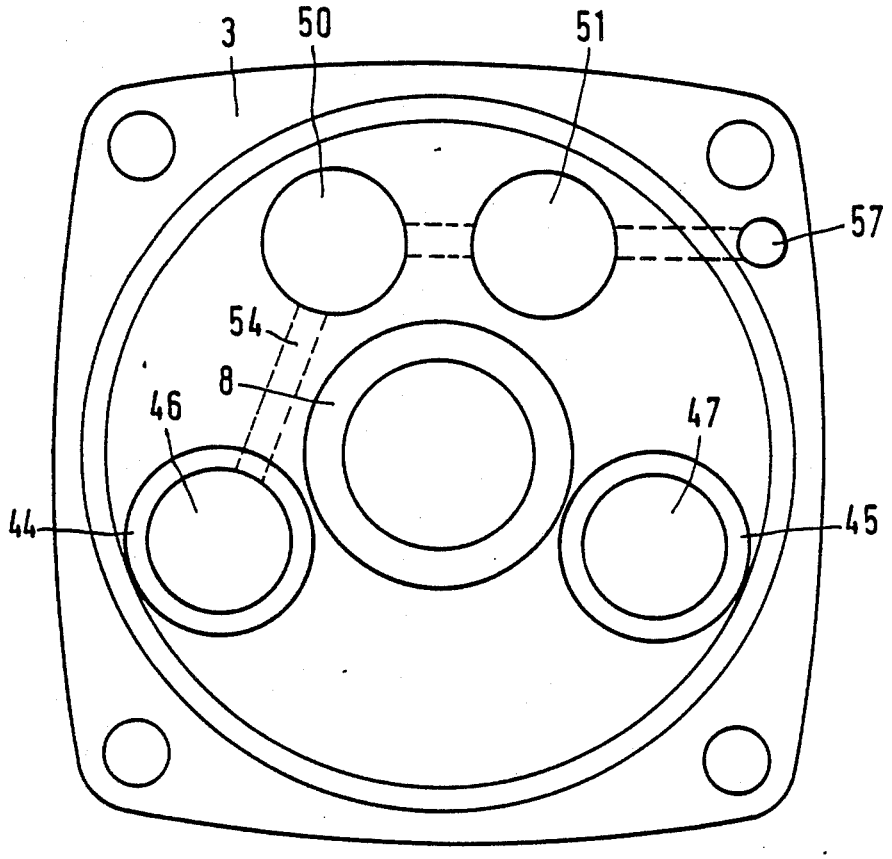
FIG. 3 is an elevation from the left hand side onto the right hand transverse wall of the housing.

The oblique plate 16 has an adjustable inclination so as to change the pumping volume if the engine works as a pump or the rotary speed if the engine works as a motor. For this purpose, the oblique plate 16 is pivotably mounted about a pivot axis S in a slide bearing 42 which takes up only part of the surface of the oblique plate 16 and transverse wall 3. This slide bearing is formed by a bearing element on the oblique plate 16 in the form of two partial ball members 43 and two complementary bearing cups 44 and 45 (FIG. 3). The partial ball members and bearing cups are mutually offset in the direction of the pivot axis S. The bearing cups are disposed near the diametral line of the transverse wall 3 to both sides of the shaft bearing formed by the bushing 8. The bearing cups 44 and 45 comprise a chamber 46 or 47 within an annular bearing surface.

Figure 2:
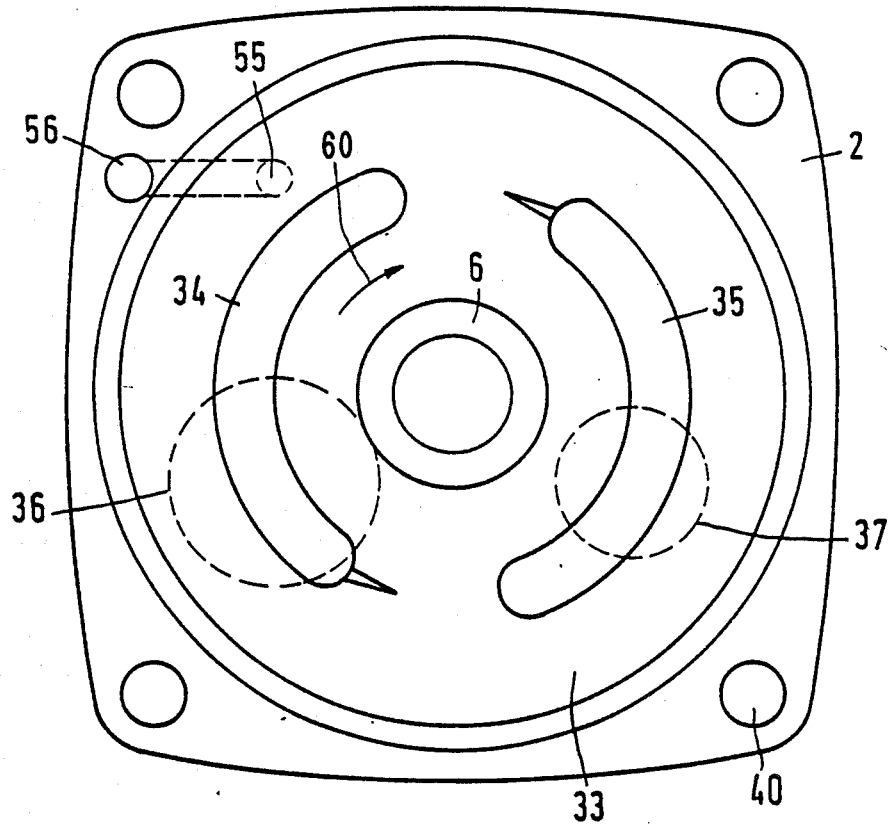
FIG. 2 is an elevation from the right hand side onto the left hand transverse wall of the housing.
Figure 4:
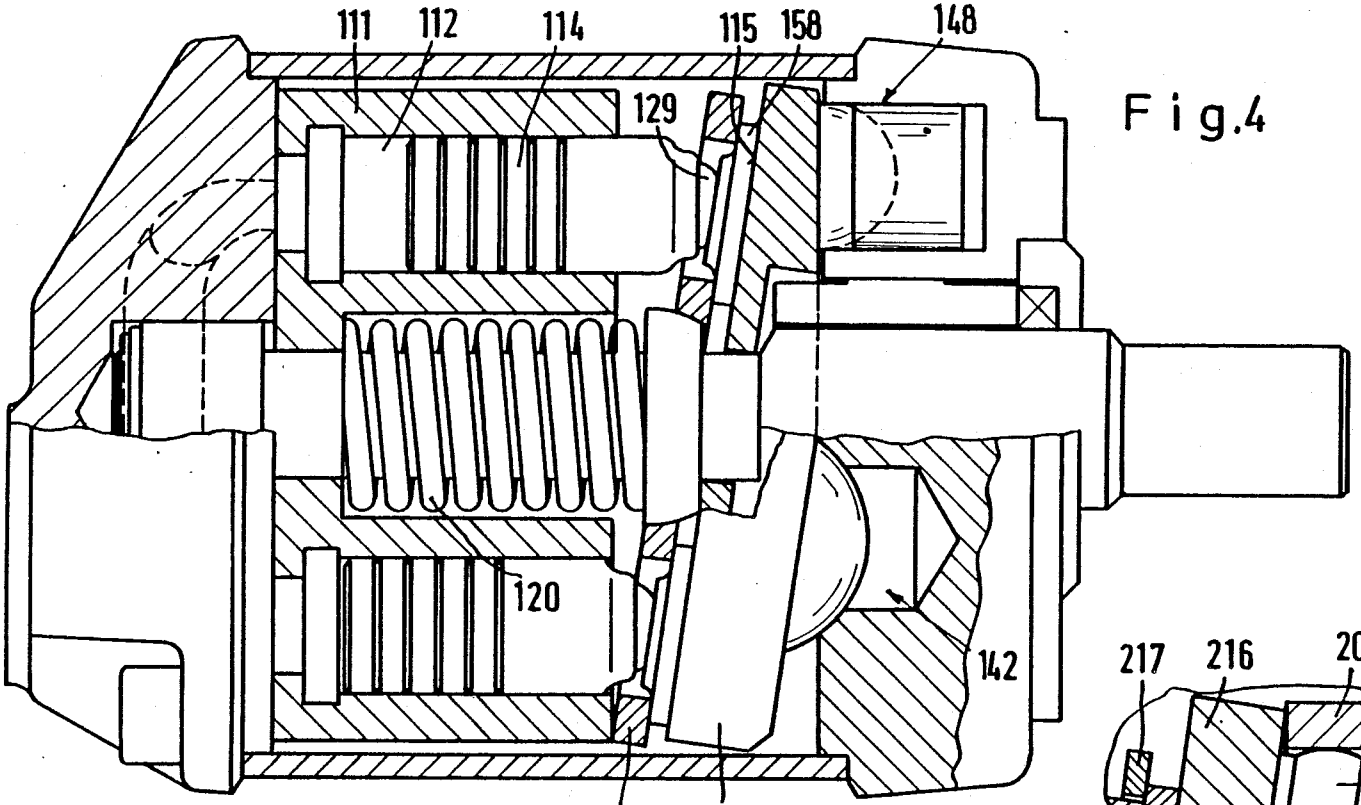
FIG. 4 is a longitudinal section through a second embodiment.
Figure 5:
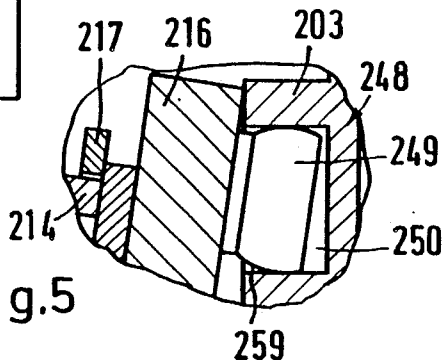
FIG. 5 is a part-longitudinal section through a modified servo-device.

Further, two servo-devices 48 are provided on the same side of the oblique plate 16 as the slide bearing 42, namely adjacent to this slide bearing. Each servo-device consists of a servo-piston 49 and a servo-piston 50 or 51 (FIG. 3). The servo-cylinders are in the form of bores in the transverse wall 3. At its outer end, each servo-piston has a spherical depression 52 in which there engages a partial ball member 53 which is frictionally applied to the oblique plate 16. The diameter of the partial ball member corresponds to that of the servo-cylinder bore. The chamber 46 of the bearing cup 44 arranged opposite to the piston-cylinder units 13 that are under pressure communicates by way of a passage 54 with both piston spaces of the servo-devices 48 and is, as are the latter, supplied with a regulated pressure by a regulating device. This pressure is supplied to the servo-devices and the chamber 46 by way of a connector 55 at the transverse wall 2 and a passage system comprising the bores 56 and 57. Depending on this pressure or the amount of pressure fluid enclosed in the chambers, the oblique plate 16 will assume a particular inclination. At least the pressure-loaded slide bearing 42 is hydrostatically supported so that little resistance is offered to the pivotal movements. This servo-device for the oblique plate likewise has an axial length which is very short. The construction is simple. Since the partial ball members 43 and 53 are pressed into the bearing cup 44 or the depression 52 of piston 49 by the spring 20, the oblique plate 16 is also securely locked in the transverse direction. In the FIG. 4 embodiment, corresponding parts bear reference numerals increased by 100 relatively to FIGS. 1 to 3. The main difference is that the pistons 114 are axially guided in cylinders 112 of the rotating carrier 111 and connected by way of a pivot joint 129 to a slide shoe 158 which, in turn, carries the slide face 115. The slide shoe is loaded by spring 120 through the pressure plate 117. The slide bearing 142 and servo-device 148 are constructed as in the example of FIGS. 1 to 3. In the FIG. 5 embodiment, reference numerals increased by 200 are employed. The main difference is that the piston 249 of the servo-device 248 is fixed to the oblique plate 216 and has a spherical circumferential surface 259. This piston seals and at the same time permits pivotal motion. Modifications of the illustrated construtions are possible in many respects. For example, the slide bearing may consist of a cylindrical section and a part-cylindrical bearing surface instead of concave members and associated cups. It is also possible to apply the pistons of the piston-cylinder units to the rotating carrier and the slide face to the cylinders.

I claim:

1. An adjustable axial piston engine, comprising, a housing that includes an end wall and an end wall member in spaced relation having respective aligned bearings, a shaft mounted in said bearings for rotation about an axis of rotation, a rotary carrier attached to said shaft adjacent to said end wall, an oblique plate member disposed adjacent to said end wall member in surrounding relationship to said shaft and pivotable about a pivot axis that is perpendicular to the axis of rotation and offset from the axis of rotation, a plurality of piston-cylinder units extending between said carrier and said oblique plate member, each unit including a cylinder element carried by said carrier and a piston unit in sliding arrangement with said oblique plate member, pivot axis means for said plate member on one side of the shaft including first and second slide bearing means between said plate member and said end wall member, each bearing means including a partial ball member having a round surface portion, and servo means between said plate member and said end wall on the opposite side of said shaft for pivoting said plate member about said pivot axis, said servo means including a partial ball member having a spherical circumferential portion that is larger than a hemisphere and a fluid actuated piston having a partial spherical depression into which the spherical surface portion extends, the servo means partial ball member and the bearing means partial ball member each being in frictional engagement with the plate member opposite said piston-cylinder units, and said end wall member having a bearing cup depression for each bearing means into which each bearing means partial ball member extends in abutting relationship to the end wall member and a chamber bore in which the piston is mounted and into which the servo means partial ball member extends, the servo means partial ball member having a diameter that corresponds to the diameter of said bore.

* * * * *